United States Patent [19]

Diard et al.

[11] Patent Number: 4,869,523

[45] **Date of Patent: * Sep. 26, 1989**

[54] SKI WITH VARIABLE DISSYMMETRICAL LATERAL SURFACES

[75] Inventors: Jean-Luc Diard, Annecy; Roger Pascal, Annecy Le Vieux, both of France

[73] Assignee: Salomon S.A., Annecy Cedex, France

[ * ] Notice: The portion of the term of this patent subsequent to Jan. 3, 2006 has been disclaimed.

[21] Appl. No.: 49,930

[22] Filed: May 15, 1987

[30] Foreign Application Priority Data

May 23, 1986 [FR] France ..... 86 07851

[51] Int. Cl.[4] ..... A63C 5/04

[52] U.S. Cl. ..... 280/609

[58] Field of Search ..... 280/601, 608, 609, 600, 280/28; 441/65, 68, 79; 114/274, 283, 288

[56] References Cited

U.S. PATENT DOCUMENTS

| | | | |
|---|---|---|---|
| Re. 29,659 | 6/1978 | Bildner | 280/608 |
| 4,433,855 | 2/1984 | Wyke | 280/609 |

FOREIGN PATENT DOCUMENTS

| | | |
|---|---|---|
| 1958349 | 5/1971 | Fed. Rep. of Germany . |
| 2461890 | 10/1976 | Fed. Rep. of Germany . |
| 3441058 | 5/1986 | Fed. Rep. of Germany . |
| 1343014 | 10/1963 | France . |
| 2509185 | 1/1983 | France . |
| 2517548 | 6/1983 | France . |
| 2522976 | 9/1983 | France . |
| 2559673 | 8/1985 | France . |
| 4324330 | 10/1968 | Japan . |

*Primary Examiner*—Charles A. Marmor
*Assistant Examiner*—Tamara L. Finlay
*Attorney, Agent, or Firm*—Sandler & Greenblum

[57] ABSTRACT

A ski which includes a lower sliding surface connected to an upper surface by a first lateral surface and a second lateral surface along two opposed sides of the ski. Each of the first and second lateral surfaces is inclined and forms first and second inclination angles, respectively, with the lower surface. In the front portion of the ski, the first inclination angle is less than the second inclination angle, while in the rear portion of the ski first inclination angle is greater than the second inclination angle.

51 Claims, 4 Drawing Sheets

SKI WITH VARIABLE DISSYMMETRICAL LATERAL SURFACES

BACKGROUND OF THE INVENTION

1. Field of the Invention

The present invention relates to skis for use on snow or ice, utilized in connection with winter sports.

2. Description of Background Material and Relevant Information

Skis normally utilized on snow comprise a lower sliding surface connected to two lateral surfaces along two lower edges provided with metallic corners, the lateral surfaces being connected to an upper surface. The lateral surfaces are generally substantially perpendicular to the lower and upper surfaces. The width of the lower surface is smaller in the central portion than in the front and rear portions. Skis have a relatively small width with respect to their length, their front end being curved upwardly to form a spatula.

It has been observed that this conventional configuration of skis is disadvantageous, particularly during the use of the ski on wet or frozen snow. In effect, on wet snow, the perpendicular lateral surfaces create tremendous friction during sliding in a longitudinal direction. Particularly, during a turn, the lateral surfaces oppose flat pivoting of the ski. Similarly, on frozen snow, the lateral surfaces oppose penetration of the skis' corners into the snow.

Conventionally, skis have a transverse configuration, which is substantially symmetrical with respect to a vertical median longitudinal plane. Such a structure defines in a relatively rigid and unchangeable fashion, the fundamental parameters of the ski, such as the parameters of flexion, torsion, vibration, reaction on snow, etc.

SUMMARY OF THE INVENTION

It is an object of the invention to provide a ski which includes a front portion, a central portion, and a rear portion, in which the central portion is adapted to receive a ski binding. The ski includes an upper surface having a first edge and a second edge, a lower sliding surface having a first edge portion and a second edge portion, and two lateral surfaces connecting the upper and lower sliding surfaces. Each of the lateral surfaces are inclined with respect to the lower sliding surface, and form a first and second angle of inclination respectively, such that one of the angles is greater than the other of the angles in one of the front or rear portions of the ski. Each angle of inclination is less than about 90°, and preferably, less than about 70°, and the difference between the first and second angles is between about 10°-20°.

The ski according to the invention is curved upwardly at a tip end thereof, thereby forming a spatula. Each of the first and second lateral surfaces and each of the upper and lower surfaces are substantially planar. One or both of the first and second lateral surfaces comprise an upper inclined portion and a substantially vertical lower portion. The upper inclined portion being substantially planar.

The ski according to the invention further includes a front zone, a central zone adapted to receive a ski binding, and a rear zone.

Each of the first and second lateral surfaces converge on the spatula such that the first and second angles of inclination continuously decrease toward zero at the tip portion of the ski. Each of the first and second edge portions of the lower sliding surface includes a metallic corner.

It is another object of the invention to provide a ski in which the first angle of inclination is greater than the second angle of inclination in the front portion of the ski, and conversely, the first angle of inclination is smaller than the second angle of inclination in the rear portion of the ski. Both of the angles of inclination are either constant, or variable in a continuous fashion along the length of the ski.

The width of the upper surface is either substantially constant or variable, and the width of the lower sliding surface is variable along the longitudinal length of the ski.

It is another object of the invention to provide a ski wherein a vertical median plane of the upper surface intersects with a vertical median plane of the lower sliding surface.

It is another object of the invention to provide a ski in which at least a portion of each of the first and second lateral surfaces is inclined relative to the lower surface along the longitudinal extent of the ski, thereby forming a first angle of inclination and a second angle of inclination, respectively, such that the inclined portion defines a useful length of the ski. One of the first and second angles of inclination at any cross-section of the ski is greater than the other of the first and second angles of inclination in one of the front and rear portions of the ski. Each of the first and second angles of inclination being substantially constant or variable along the useful length of the ski.

It is another object of the invention to provide a ski in which at least a portion of each of the first and second lateral surfaces is inclined relative to the lower surface, thereby forming a first angle of inclination and a second angle of inclination, respectively, along the longitudinal length of the ski and another portion of each of the first and second lateral surfaces being substantially vertical relative to the lower surface thereby forming an internal angle of 90°.

It is another object of the invention to provide a ski in which a portion of each of the first lateral surface and the second lateral surface is inclined relative to the lower surface thereby forming a first angle of inclination and a second angle of inclination along the longitudinal length of the ski, respectively, and another portion of each of the first and second lateral surfaces being substantially vertical relative to the lower surface thereby forming an angle of 90°. One of the first and second lateral surfaces forms along any cross-section of the ski, an angle of inclination of about 90° in the front portion of the ski, and the other of the first and second lateral surfaces forms an angle of inclination of about 90° in the rear portion of the ski.

BRIEF DESCRIPTION OF THE DRAWINGS

Other objects, characteristics and advantages of the present invention will become clear from the following description, with reference to particular embodiments, provided with reference to the annexed drawings, in which:

FIGS. 6–8 illustrate an alternative embodiment, in which FIG. 6 is a view similar to FIG. 4, FIG. 7 is a view similar to FIG. 5, and FIG. 8 is a top view.

DESCRIPTION OF PREFERRED EMBODIMENTS

Figure 1:
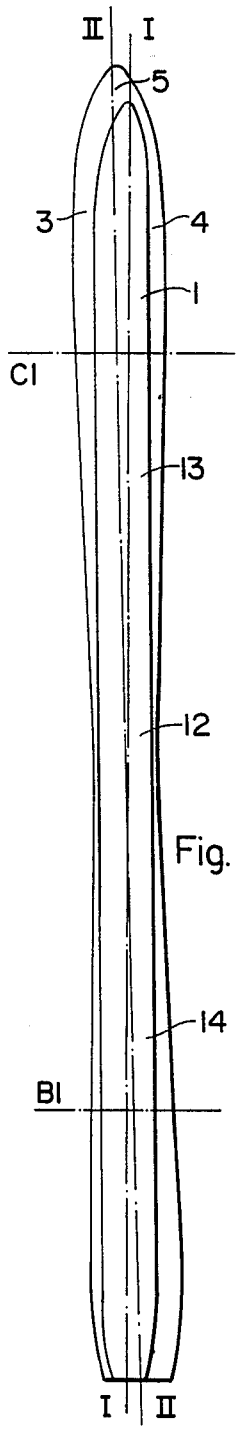
FIGS. 1-3 illustrate, in top plan view, three embodiments in which the vertical median planes of the upper and lower surfaces are planar and offset angularly.

The present invention has a particular object of avoiding the disadvantages associated with known ski structures, by providing very different shapes thereby making it possible to substantially adjust the fundamental mechanical parameters of the ski, and particularly the characteristics of torsion, flexion, shock absorption, resonance frequency, penetration of the corners into the snow or ice and flat pivoting.

To achieve these objects as well as others, the ski according to the invention has a dissymmetrical transverse cross-section in which the first and second lateral surfaces, respectively form with the lower surface inclination angles A1 and A2 which are generally different from one another. Angles A1 and A2 have different values as a function of a particular transverse cross-section being considered along the useful length of the body of the ski. In the largest part of a portion of the ski situated in front of the binding or central zone, angle A1 defined by the first lateral surface and the lower surface of the ski is less than angle A2 defined by the second lateral surface and the lower surface of the ski. In the largest portion of the ski situated behind the binding or central zone, angle A1 is greater than angle A2.

For this characteristic, one defines the useful length of the ski as being the total of the two portions defined, respectively, by each of the ends of the ski and by the central zone adapted to receive the boot binding.

This arrangement makes it possible to have, while maintaining a normal sliding surface, different effects of the ski during turning, depending upon whether one performs a right turn or a left turn. Thus, for the ski shown in the Figures, an overturn effect during left turns and an underturn effect during right turns is depicted.

According to a preferred embodiment, angles A1 and A2 in a transverse section are variable in a continuous fashion as a function of the longitudinal position of the transverse section on a portion of the ski. One, thus distributes in a progressive manner the resistance to a lateral displacement parallel to the sliding surface, the resistance being greatest in the zones having a large angle A, and the resistance being lowest in the zones having a small angle A.

Angles A1 and A2 are, preferably, less than 70°, and more preferably, their difference is between 10° and 20°. In this range of values, the advantages attained by the dissymmetry of the lateral surfaces are very substantial, and the different effects of the two skis utilized simultaneously by the user, particularly in the course of making turns, substantially improve their efficacy.

To this end, the skis are normally utilized in pairs, maintained in substantially parallel directions, slide along their longitudinal direction and, in the course of a turn, slide laterally. The skis according to the invention, have a dissymmetrical section with respect to a vertical median longitudinal plane, and must be paired to have reverse dissymmetries with respect to one another. For example, a right ski having in its front portion a right lateral surface that is more inclined than the left lateral surface will be paired with a left ski having in its front portion a left lateral surface which is more inclined than the right lateral surface. Conversely, a right ski having a right lateral surface which is less inclined than the left lateral surface will be paired with a left ski whose left lateral surface is less inclined than the right lateral surface. It will be appreciated that in the course of turning, the differences in symmetries of the two skis will produce different effects by the first ski with respect to the second ski. According to the invention, these effects by different ski, i.e., left or right, bring about a favorable result by the pair of skis in the course of turning, the result which favors, for example, digging in snow during turning, while maintaining the skis substantially parallel.

According to one embodiment, the upper surface and the lower surface of the ski are, respectively symmetrical with respect to the median vertical longitudinal planes. The longitudinal vertical planes are, preferably planar and offset angularly with respect to one another. One, thus, defines a regular progressive variation of the difference of angles A1 and A2 along the length of the ski.

As shown in the Figures the ski according to the invention comprises an upper surface 1, a lower sliding surface 2, and two lateral surfaces 3 and 4. The front portion 5 of the ski is curved upwardly to form a spatula. The lower surface 2 is bordered by two lower edges 6 and 7 generally provided with metallic corners. The lower surface 2, as shown in FIGS. 1–8, has, in its central portion, a relatively reduced width which progressively increases when one approaches each of the ends of the ski.

Figure 4:
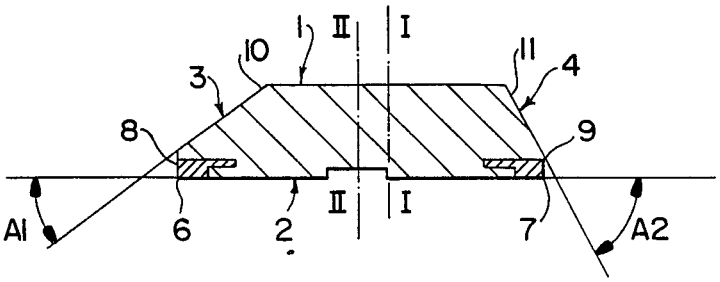
FIG. 4 is a transverse cross-section of the ski along planes C1-C3 of FIGS. 1-3.
Figure 5:
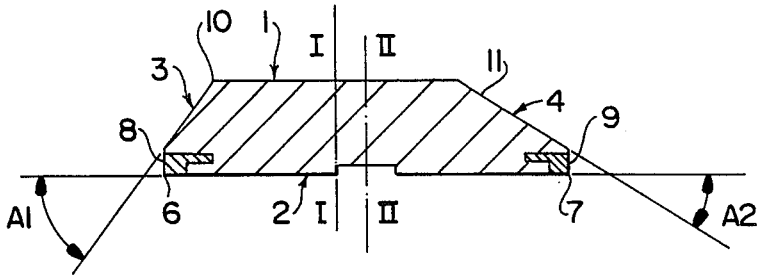
FIG. 5 is a transverse cross-section of the ski along planes B1–B3 of FIGS. 1–3.

Lateral surfaces 3 and 4 form, with lower surface 2 of the ski, inclination angles A1 and A2 of 90° or less, respectively, as shown in FIGS. 4 and 5.

In the particular embodiments shown in the Figures lateral surfaces 3 and 4 comprise a lower zone constituted by respective edges 8 and 9, substantially perpendicular to the lower surface 2 of the ski, and an upper zone 10 and 11, respectively, having angles A1 and A2. Edges 8 and 9 are, preferably, of a height of several millimeters, the largest portion of the lateral surfaces being constituted by upper zones 10 and 11.

In the embodiments, in which the lengths of upper zones 10 and 11 are variable, a line generated parallel to a transverse plane and sliding longitudinally on the lower edge respectively 8 and 9, angle A is an angle formed by the right line of the lower surface 2 of the ski in the transverse section considered. Alternatively, the transverse profile of upper zones 10 and 11, can be curvilinear. One, thus defines angle A as being an angle formed by the lower surface 2 and the line joining the lower and upper edges of upper zone 10 or 11 being considered.

According to the invention, angles A1, A2 formed in a same transverse section are generally different from one another, to provide a dissymmetry.

In the following description, given with reference to the Figures, only one of the two skis of a pair normally utilized by the skier is described. Such a ski can, for example, be a right ski, or a left ski, the effects obtained are obviously different depending upon whether the ski is attached to the right leg or to the left leg of the user. Furthermore, the second ski of the pair, not shown in the drawings, must have an inverse dissymmetry with respect to the first ski. Thus, if one considers the ski illustrated in FIGS. 4 and 5 as being a right ski, in which angle A1 of the left lateral surface is greater than the angle A2 of the right lateral surface in the rear portion of the ski, the left ski must have an angle A1 less than the angle A2 in the same rear portion.

The difference between angles A1 and A2 is, preferably between 10° and 20°, depending upon the useful length of the ski.

In the embodiments of FIGS. 1–5, angles A1 and A2 are, preferably, both less than 70°, along the useful length of the ski.

In the embodiment shown in FIG. 1, the upper surface has a variable width as a function of the position being considered along the length of the ski. The upper surface 1 and lower surface 2 are positioned with respect to one another in a manner so as to define angles A1 and A2, which are substantially variable over the useful length of the ski.

Figure 2:
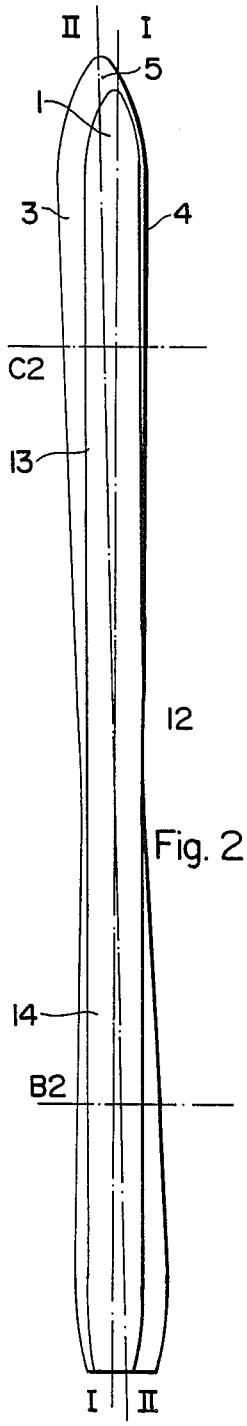

In the embodiment shown in FIG. 2, the upper surface 1 of the ski has a constant width, while the lower surface 2 has a variable width.

Figure 3:
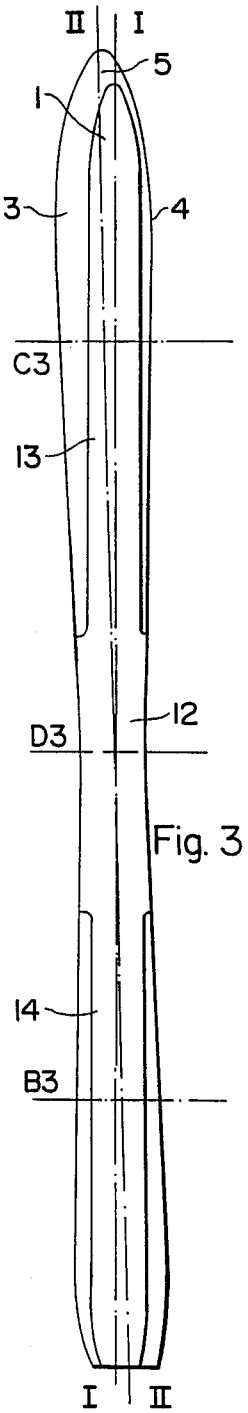
Figure 9:
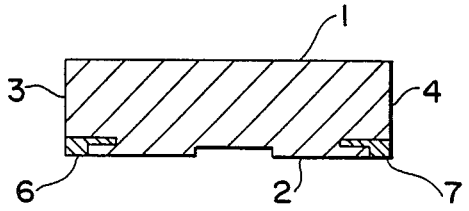
FIG. 9 is a transverse cross-section of the ski along plane $D_3$ of FIG. 3.

In the embodiment of FIGS. 3 and 9, intermediate or central zone 12 of the upper surface 1 of the ski, or zone adapted to receive the binding of the boot, is wider and defines angles A1 and A2 which are substantially equal to 90° (FIG. 9). The central zone separates front zone 13 and rear zone 14 which constitute the useful length of the ski and which extend until the vicinity of the ends.

In the three embodiments of FIGS. 1, 2 and 3, the upper surface 1 and lower surface 2 of the ski have median vertical planes respectively I—I and II—II which are angularly offset with respect to one another. Thus, in the embodiments shown, planes I—I and II—II are laterally offset in one direction in the front sections C1–C3, while they are offset in the opposite direction in the rear sections B1–B3.

Figure 8:
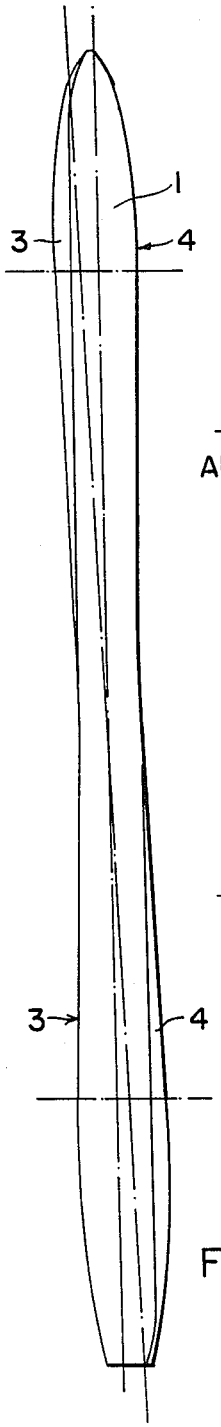
Figure 6:
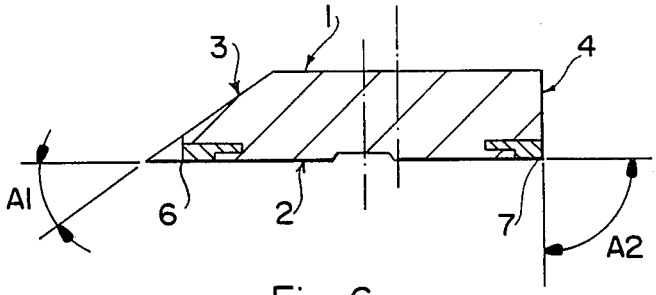
Figure 7:
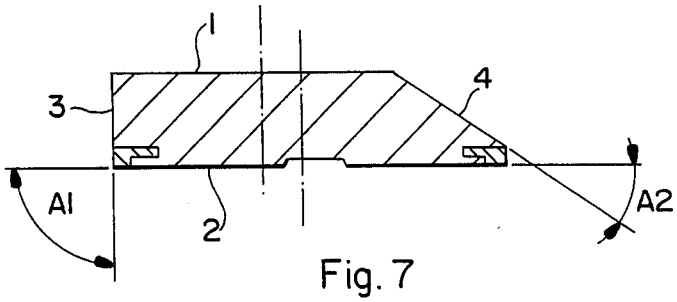

FIGS. 6, 7 and 8 are views similar to FIGS. 4 and 5 illustrating an alternative embodiment, in which one of the lateral surfaces 3, 4 is substantially perpendicular to the lower sliding surface 2. Thus, at the front portion of the ski (FIG. 6) the angle A1 is less than 90° while the angle A2 is substantially equal to 90°, and at the rear the situation is reversed, angle A1 being substantially equal to 90°, while angle A2 is less than 90°.

For clarity, the drawings of the top view show the ski whose width is relatively large with respect to their length. One, thus visually accentuates the lateral and angular offsets, which constitute the dissymmetry of the ski. One of ordinary skill in the art will understand how, of course, to adapt the dissymmetries defined by the present invention to the skis of different proportions.

Although the invention has been described with reference to particular means, materials and embodiments, it is to be understood that the invention is not limited to the particular embodiments disclosed and extends to all equivalents within the scope of the appended claims.

What is claimed is:

1. A ski for use on snow or ice, comprising:

a lower sliding surface connected to an upper surface by a first lateral surface and a second lateral surface along opposed sides of said ski, said first lateral surface and said second lateral surface being inclined relative to said lower surface and forming, respectively, with said lower surface at any cross-section of said ski, a first angle of inclination and a second angle of inclination, wherein said first angle of inclination is less than said second angle of inclination in a front zone or said ski positioned at one end of a central zone, said first angle of inclination is greater than said second angle of inclination in a rear zone of said ski positioned at a second end of said central zone.

2. The ski of claim 1, wherein each said first angle of inclination in said front zone is less than 90°, while each said second angle of inclination is substantially equal to 90°, and in said rear zone of the ski each said first angle of inclination is substantially equal to 90° while each said second angle of inclination is less than 90°.

3. The ski of claim 1, wherein each of said first and second lateral surfaces forms with said lower surface an inclination angle of less than 90°.

4. The ski of claim 1, wherein said first and said angles are variable in a continuous fashion along the length of said ski.

5. The ski of claim 1, wherein each of said first and second angles is less than 70° along the length of the ski.

6. The ski of claim 1, wherein said first and second angles of inclination differ by approximately 10°–20° at any cross-section along the length of the ski.

7. The ski of claim 1, wherein each of said upper surface and said lower surface of the ski comprises a vertical median plane, said planes intersecting each other.

8. A ski for sliding on ice or snow, comprising:

(a) a front portion, a central portion, and a rear portion, said central portion being adapted to receive a ski binding;

(b) an upper surface comprising a first edge and a second edge;

(c) a lower sliding surface comprising a first edge portion and a second edge portion; and (d) a plurality of lateral surfaces, a first one of said lateral surfaces connecting said first edge of said upper surface to said first edge portion of said lower surface, and a second one of said lateral surfaces connecting said second edge of said upper surface to said second edge portion of said lower surface;

wherein each of said first lateral surface and said second lateral surfaces is inclined relative to said lower sliding surface thereby forming a first angle of inclination and a second angle of inclination, respectively, at any cross-section along the length of the ski, one of said first angle of inclination and said second angle of inclination being greater than the other of said first and second angles of inclination in one of said front portion and said rear portion of the ski.

9. The ski of claim 8, wherein each said first angle of inclination is greater than each said second angle of inclination in said front portion of the ski.

10. The ski of claim 9, wherein each said first angle of inclination is smaller than each said second angle of inclination in said rear portion of the ski.

11. The ski of claim 8, wherein said first and said second angles of inclination vary along the longitudinal length of the ski.

12. The ski of claim 11, wherein a vertical median plane of said upper surface intersects with a vertical median plane of said lower sliding surface.

13. The ski of claim 12, wherein the width of said upper surface and the width of said lower surface are both variable, along the longitudinal length of the ski.

14. The ski of claim 12, wherein the width of said upper surface is substantially constant while the width of said lower surface is variable along the longitudinal length of the ski.

15. The ski of claim 8, wherein each of said first and said second angles of inclination are less than about 90°.

16. The ski of claim 15, wherein each of said first and said second angles of inclination at any cross-section of the ski, vary by between about 10°–20°.

17. The ski of claim 8, wherein each of said first and said second angles of inclination are less than about 70°.

18. The ski of claim 17, wherein each of said first and said second angles of inclination at any cross-section of the ski, vary by between about 10°–20°.

19. The ski of claim 8, wherein at least one of said first lateral surface and said second lateral surface comprises an upper inclined portion and a substantially vertical lower portion.

20. The ski of claim 19, wherein each of said first lateral surface and said second lateral surface comprises an upper portion and a lower portion.

21. The ski of claim 20, wherein said upper inclined portion is substantially planar.

22. The ski of claim 8, wherein said front portion comprises a tip portion which is curved upwardly to form a spatula.

23. The ski of claim 22, further comprising a front lateral surface and said second lateral surface converge on said spatula such that said first and second angles of inclination continuously decrease towards zero at said tip portion of the ski.

24. The ski of claim 8, wherein each of said first edge portion and said second edge portion comprises a metallic corner.

25. A ski for sliding on ice or snow, comprising:

(a) a front portion, a central portion, and a rear portion, said central portion being adapted to receive a ski binding;

(b) an upper surface comprising a first edge and a second edge;

(c) a lower sliding surface comprising a first edge portion and a second edge portion; and (d) a plurality of lateral surfaces, a first one of said lateral surfaces connecting said first edge of said upper surface to said first edge portion of said lower surface, and a second one of said lateral surfaces connecting said second edge of said upper surface to said second edge portion of said lower surface;

wherein at least a portion of each of said first lateral surface and said second lateral surface, along the longitudinal extent of the ski, is inclined relative to said lower surface thereby forming a first angle of inclination and a second angle of inclination, respectively, said inclined portions of said first and second lateral surfaces together defining a useful length of the ski, one of said first angle of inclination and said second angle of inclination being greater than the other of said first and second angles of inclination at any cross-section of one of said front and rear portions of the ski.

26. The ski of claim 25, wherein each said first angle of inclination is greater than each said second angle of inclination in said front portion of the ski.

27. The ski of claim 26, wherein each said first angle of inclination is smaller than each said second angle of inclination is said rear portion of the ski.

28. The ski of claim 25, wherein each of said first angle of inclination and said second angle of inclination is substantially constant along said useful length of the ski.

29. The ski of claim 25, wherein each of said first and said second angles of inclination are variable along said useful length of the ski.

30. The ski of claim 29, wherein a vertical median plane of said upper surface intersects with a vertical median plane of said lower sliding surface.

31. The ski of claim 30, wherein the width of said upper surface is substantially constant, while the width of said lower surface is variable along the longitudinal length of the ski.

32. The ski of claim 25, wherein at least another portion of each of said first lateral surface and said second lateral surface is substantially perpendicular relative to said lower sliding surface thereby forming an angle of inclination of about 90°.

33. The ski of claim 25, wherein each of said first angle of inclination and said second angle of inclination is less than about 90° along and, cross-section of the ski.

34. The ski of claim 25, wherein each of said first angle of inclination and said second of inclination is less than about 70°.

35. The ski of claim 34, wherein said first and said second angles of inclination vary by between about 10–20°.

36. The ski of claim 25, wherein at least one of said first lateral surface and said second lateral surface comprises an inclined upper portion and a substantially vertical lower portion.

37. The ski of claim 36, wherein each of said first lateral surface and said second lateral surface comprises an upper portion and a lower portion.

38. The ski of claim 37, wherein said inclined upper portion is substantially planar.

39. The ski of claim 25, portion comprises a tip portion which is curved upwardly to form a spatula.

40. The ski of claim 39, wherein each of said first lateral surface and said second lateral surface converge on said spatula such that said first and second angles of inclination continuously decrease towards zero at said tip portion of the ski.

41. The ski of claim 25, wherein each of said first edge portion and said second edge portion comprises a metallic corner.

42. A ski for sliding on ice or snow, comprising:

(a) a front portion, a central portion, and a rear portion, said central portion being adapted to receive a ski binding;

(b) an upper surface comprising a first edge, a second edge, and a vertical median plane;

(c) a lower sliding surface comprising a first edge portion, a second edge portion, and a vertical median plane, wherein said vertical median plane of said upper surface is angularly offset with respect to said vertical median plane of said lower sliding surface; and (d) a plurality of lateral surfaces, a first one of said lateral surfaces connecting said first edge of said upper surface to said first edge portion of said lower surface, and a second one of said lateral surfaces connecting said second edge of said upper surface to said second edge portion of said lower surface;

wherein at least a portion of each of said first lateral surface and said second lateral surface, along the longitudinal length of the ski, is inclined relative to said lower surface thereby forming a first angle of inclination and a second angle of inclination, respectively, and another portion of each of said first and second lateral surfaces as viewed along the length of the ski, is substantially vertical relative to said lower surface.

43. The ski of claim 42, wherein one of said first lateral surface and said second lateral surface forms along any cross-section of said front portion of the ski an angle of inclination of about 90°, and the other of said first and second lateral surfaces forms an angle of inclination of about 90° along any cross-section of the ski in said rear portion.

44. The ski of claim 42, wherein each of said first and said second angles of inclination is less than about 90° along the longitudinal length of the ski.

45. The ski of claim 42, wherein said front portion is curved upwardly at a tip end thereof thereby forming a spatula.

46. The ski of claim 45, wherein each of said first lateral surface and said second lateral surface converge on said spatula such that said first and second angles of inclination continuously decrease towards zero at said tip portion of said ski.

47. The ski of claim 42, wherein each of said first lateral surface and said second lateral surface is substantially planar.

48. The ski of claim 42, wherein each of said upper first surface and said lower surface is substantially planar.

49. The ski of claim 42, wherein each of said first lateral surface and said second lateral surface comprises an upper portion and a lower portion.

50. The ski of claim 49, wherein said inclined upper portion is substantially planar.

51. The ski of claim 42, wherein each of said first edge portion and said second edge portion comprises a metallic corner.

* * * * *

UNITED STATES PATENT AND TRADEMARK OFFICE

CERTIFICATE OF CORRECTION

PATENT NO. : 4,869,523

DATED : September 26, 1989

INVENTOR(S) : Jean-Luc DIARD et al.

It is certified that error appears in the above-identified patent and that said Letters Patent is hereby corrected as shown below:

At column 5, line 68 (claim 1, line 11), change "or" to ---of---.

At column 7, line 25 (claim 23, line 1), change "further comprising a front" to ---wherein each of said first---.

At column 8, line 36 (claim 39, line 1), insert ---wherein said front--- after "25".

Signed and Sealed this

Twenty-sixth Day of January, 1993

*Attest:*

STEPHEN G. KUNIN

*Attesting Officer*

*Acting Commissioner of Patents and Trademarks*